US009204694B2

(12) United States Patent
Gasparrini

(10) Patent No.: US 9,204,694 B2
(45) Date of Patent: Dec. 8, 2015

(54) METHODS OF APPLYING CRIMPING SLEEVES TO WIRES

(71) Applicant: Laura Gasparrini, Santa Barbara, CA (US)

(72) Inventor: Laura Gasparrini, Santa Barbara, CA (US)

( * ) Notice: Subject to any disclaimer, the term of this patent is extended or adjusted under 35 U.S.C. 154(b) by 5 days.

(21) Appl. No.: 14/180,840

(22) Filed: Feb. 14, 2014

(65) Prior Publication Data

US 2014/0223742 A1 Aug. 14, 2014

Related U.S. Application Data

(63) Continuation of application No. 13/362,693, filed on Jan. 31, 2012, now Pat. No. 8,650,688.

(51) Int. Cl.

| | |
|---|---|
| ***B25B 7/22*** | (2006.01) |
| ***A44C 27/00*** | (2006.01) |
| ***B25B 7/02*** | (2006.01) |
| ***B25B 7/08*** | (2006.01) |
| ***B25B 27/14*** | (2006.01) |

(52) U.S. Cl.

CPC . *A44C 27/00* (2013.01); *B25B 7/02* (2013.01); *B25B 7/08* (2013.01); *B25B 27/146* (2013.01); *Y10T 29/4959* (2015.01); *Y10T 29/49929* (2015.01)

(58) Field of Classification Search

CPC ..... B25B 7/22; B25B 7/02; B25B 7/08; B25B 29/146; A61C 7/04; Y10T 29/4959; Y10T 29/49929; A44C 27/00

USPC ..... 7/125, 132–134, 158; 81/9.42, 9.51, 81/300, 415, 418, 419

See application file for complete search history.

(56) References Cited

U.S. PATENT DOCUMENTS

| | | | | |
|---|---|---|---|---|
| 744,167 | A | 11/1903 | Collins | |
| 1,858,418 | A | 5/1932 | Rowley | |
| 2,571,819 | A | 10/1951 | Boel et al. | |
| 3,058,213 | A | 10/1962 | Sandsto | |
| 3,172,319 | A | 3/1965 | Stanfield | |
| 4,070,745 | A | 1/1978 | Schimmelman | |
| 4,206,663 | A | 6/1980 | Pace | |
| 4,208,749 | A | 6/1980 | Hermann et al. | |
| 4,796,318 | A | 1/1989 | Bigei | |
| 4,953,248 | A * | 9/1990 | Trombetta | 7/107 |
| 5,042,285 | A | 8/1991 | Levy | |
| 5,724,688 | A * | 3/1998 | Chen | 7/128 |
| 5,839,141 | A | 11/1998 | Hermann | |
| 6,035,748 | A | 3/2000 | Burch | |
| 6,588,039 | B1 | 7/2003 | Bates | |
| 6,618,885 | B1 | 9/2003 | Blaustein | |
| 6,934,991 | B2 | 8/2005 | Kinkade | |
| 2004/0200060 | A1 | 10/2004 | Shutts et al. | |

* cited by examiner

*Primary Examiner* — Lee D Wilson
*Assistant Examiner* — Melanie Alexander
(74) *Attorney, Agent, or Firm* — SoCal IP Law Group LLP; Guy L. Cumberbatch; Mark A. Goldstein

(57) ABSTRACT

The present invention relates to crimpers and shears used in the jewelry making industry. The invention includes a new and improved set of tools for crimping multiple sleeve sizes used in the making of necklaces, bracelets, and the like. One embodiment provides a single tool that is operable for crimping bead sleeves of one or more sizes. Another embodiment combines both crimping and shearing functions in a single tool.

20 Claims, 8 Drawing Sheets

METHODS OF APPLYING CRIMPING SLEEVES TO WIRES

RELATED APPLICATION INFORMATION

The present application claims priority under 35 U.S.C. §120 as a continuation of U.S. patent application Ser. No. 13/362,693, now issued as U.S. Pat. No. 8,650,688, filed Jan. 31, 2012.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

FIELD OF THE INVENTION

The present application relates to devices for crimping and finishing beadwork.

BACKGROUND OF THE INVENTION

Beadwork is the art or craft of attaching beads to one another or to cloth, usually by the use of a needle and thread or soft, flexible wire. Most cultures have employed beads for personal adornment such as jewelry. Beads have also been used for religious purposes, as good luck talismans, and as curative agents. Archaeological records show that people made and used beads as long as 5,000 years ago.

In modern day beadwork, beads are generally threaded onto a beading wire and secured using a crimping technique. Such techniques involve the use of a crimping device and crimp beads. The crimp beads provide a finished end of the beaded piece and create a loop for clasp attachment.

Modern crimping devices generally resemble a pair of pliers with a raised boss and mated recess on the inner surfaces of the plier jaws. The crimping sleeve is pressed between the boss and recess, thereby flattening the crimping sleeve against the two ends of the looped beading wire. The crimping sleeve is folded and again pressed, forming a generally u-shaped cross section. Both steps must be performed to insure a secure hold. The weakness of this method is that it has very little tolerance for error and often results in a non-secure finish to the work.

The present invention addresses such issues. It provides a modified crimping tool that provides a firmly secured finished end to the bead work while tolerating a wide range of craftmanship error. Moreover, the tool of the present invention eliminates the necessity to perform a second step, thereby saving time and effort.

SUMMARY OF THE INVENTION

The present application is directed towards a new and improved tool for craft work, particularly beading. In one embodiment, the shear and crimping functions are combined in a single tool. In a second embodiment, multiple crimping positions are provided to accommodate different sleeve sizes. The crimpers of the present invention eliminate the need for a second step, thereby increasing efficiency and simplifying the process.

For the purposes of this invention, the term "beading wire" refers to metallic wire, plastic line, nylon coated metallic wire, monofilament line and the like used for the making of jewelry such as necklaces and bracelets.

With the above summary in mind, it is an objective of this invention to provide:

- a crimping tool that provides a simple, secure lock to a finished line of beadwork,
- a crimping tool that can accommodate several crimping sleeve sizes into a single tool.
- A crimping tool that can provide both shearing and crimping functions into a single tool.

These goals are realized by the following sets of embodiments.

First set of embodiments: A crimper for beadwork is described. The crimper (101) comprises a first crossed member and a second crossed member. The first crossed member has a first handle at one end, a first jaw (105) at the opposite end and a first joint section (106) in between. The second crossed member has a second handle at one end, a second jaw (104) at the opposite end and a second joint section in between. The first joint section is rotatably connected to the second joint section in a scissor-like fashion.

The first jaw of the first crossed member has a first long dimension and a first width. A recessed dip (102) is positioned across the first width of the first jaw (105). The second jaw (104) of the second crossed member has a second long dimension and a second width. A protruding boss (103) is positioned across the second width of the second jaw (104), such that a crimping site is formed by the protruding boss (103) being mateably positioned within the recessed dip (102) as the jaws are closed.

The protruding boss further has a serrated surface. The serrated surface comprises a parallel series of alternating teeth and grooves. The parallel series is perpendicular to the long dimension of the second jaw, such that upon deployment of a wire-threaded beading sleeve between the jaws of the crossed members, a crimp is formed that disrupts and prevents any direct line of force being applied to the wires across the length of the crimping sleeve.

The crimper of the first embodiment may further comprising an additional crimping site. The additional crimping site is identical to the original crimping site except that it is spatially offset and is of a different size. The first jaw may further comprises a first tip opposite the first joint section. The second jaw may further comprises a second tip opposite the second joint section, and wherein cutting blades are incorporated into the first tip and the second tip, such that the crimper is enabled to perform the functions of both crimping and cutting. Multiple crimping sites may be incorporated as well.

Second set of embodiments: A crimper for beadwork is described. The crimper comprises a first crossed member and a second crossed member. The first crossed member has a first handle at one end, a first jaw at the opposite end and a first joint section in between. The second crossed member has a second handle at one end, a second jaw at the opposite end and a second joint section in between. The first joint section is rotatably connected to the second joint section in a scissor-like fashion.

The first jaw of the first crossed member has a first long dimension and a first width. A recessed dip is positioned across the first width of the first jaw. The second jaw of the second crossed member has a second long dimension and a second width. A protruding boss is positioned across the second width of the second jaw, such that a crimping site is formed by the protruding boss being mateably positioned within the recessed dip as the jaws are closed.

The recessed dip further has a serrated surface. The serrated surface comprises a parallel series of alternating teeth and grooves. The parallel series is perpendicular to the long dimension of the first jaw, such that upon deployment of a wire-threaded beading sleeve between the jaws of the crossed members, a crimp is formed that disrupts and prevents any direct line of force being applied to the wires across the length of the crimping sleeve.

The crimper of the second embodiment may further comprising an additional crimping site. The additional crimping site is identical to the original crimping site except that it is spatially offset and is of a different size. The first jaw may further comprises a first tip opposite the first joint section. The second jaw may further comprises a second tip opposite the second joint section, and wherein cutting blades are incorporated into the first tip and the second tip, such that the crimper is enabled to perform the functions of both crimping and cutting. Multiple crimping sites may be incorporated as well.

Third set of embodiments: A crimper for beadwork is described. The crimper comprises a first crossed member and a second crossed member. The first crossed member has a first handle at one end, a first jaw at the opposite end and a first joint section in between. The second crossed member has a second handle at one end, a second jaw at the opposite end and a second joint section in between. The first joint section is rotatably connected to the second joint section in a scissor-like fashion.

The first jaw of the first crossed member has a first long dimension and a first width. A recessed dip is positioned across the first width of the first jaw. The second jaw of the second crossed member has a second long dimension and a second width. A protruding boss is positioned across the second width of the second jaw, such that a crimping site is formed by the protruding boss being mateably positioned within the recessed dip as the jaws are closed.

The recessed dip further has a first serrated surface. The first serrated surface comprises a first parallel series of alternating teeth and grooves. The first parallel series is perpendicular to the long dimension of the first jaw.

The protruding boss further has a second serrated surface. The second serrated surface comprises a second parallel series of alternating teeth and grooves. The second parallel series is perpendicular to the long dimension of the second jaw and mateable to the first parallel series, such that upon deployment of a wire-threaded beading sleeve between the jaws of the crossed members, a double crimp is formed that disrupts and prevents any direct line of force being applied to the wires across the length of the crimping sleeve.

The crimper of the third embodiment may further comprising an additional crimping site. The additional crimping site is identical to the original crimping site except that it is spatially offset and is of a different size. The first jaw may further comprises a first tip opposite the first joint section. The second jaw may further comprises a second tip opposite the second joint section, and wherein cutting blades are incorporated into the first tip and the second tip, such that the crimper is enabled to perform the functions of both crimping and cutting. Multiple crimping sites may be incorporated as well.

DESCRIPTION OF THE PREFERRED EMBODIMENTS

Description of the Items in the Figures

101—crimping tool
102—recessed dip
103—tooth
104—toothed jaw
105—dip jaw
106—joint
201—double position/double sized crimping tool
202—first sized recessed
203—second sized recessed
204—first sized tooth
205—second sized tooth
401—combination shear/crimping tool
402—cutting blades
501—beading wire
502—crimping sleeve
503—metallic core of beading wire
504—pliable sheath of beading wire
505—looped strand of beading wire
601—crimper nose of present device
602—shaped tooth
603—shaped crimped sleeve with inserted bead wires
604—shaped surface
701—crimper nose of prior art device
702—prior art tooth
703—crimped sleeve with inserted bead wires
704—smooth surface
801—crimper nose of present device (alternative embodiment)
802—upper shaped tooth (alternative embodiment)
901—crimper nose of present device (second alternative embodiment)
902—upper shaped tooth (second alternative embodiment)
903—lower shaped tooth (second alternative embodiment)

DESCRIPTION OF THE ITEMS IN THE FIGURES

Figures 5A, 5B, 5C, 5D:
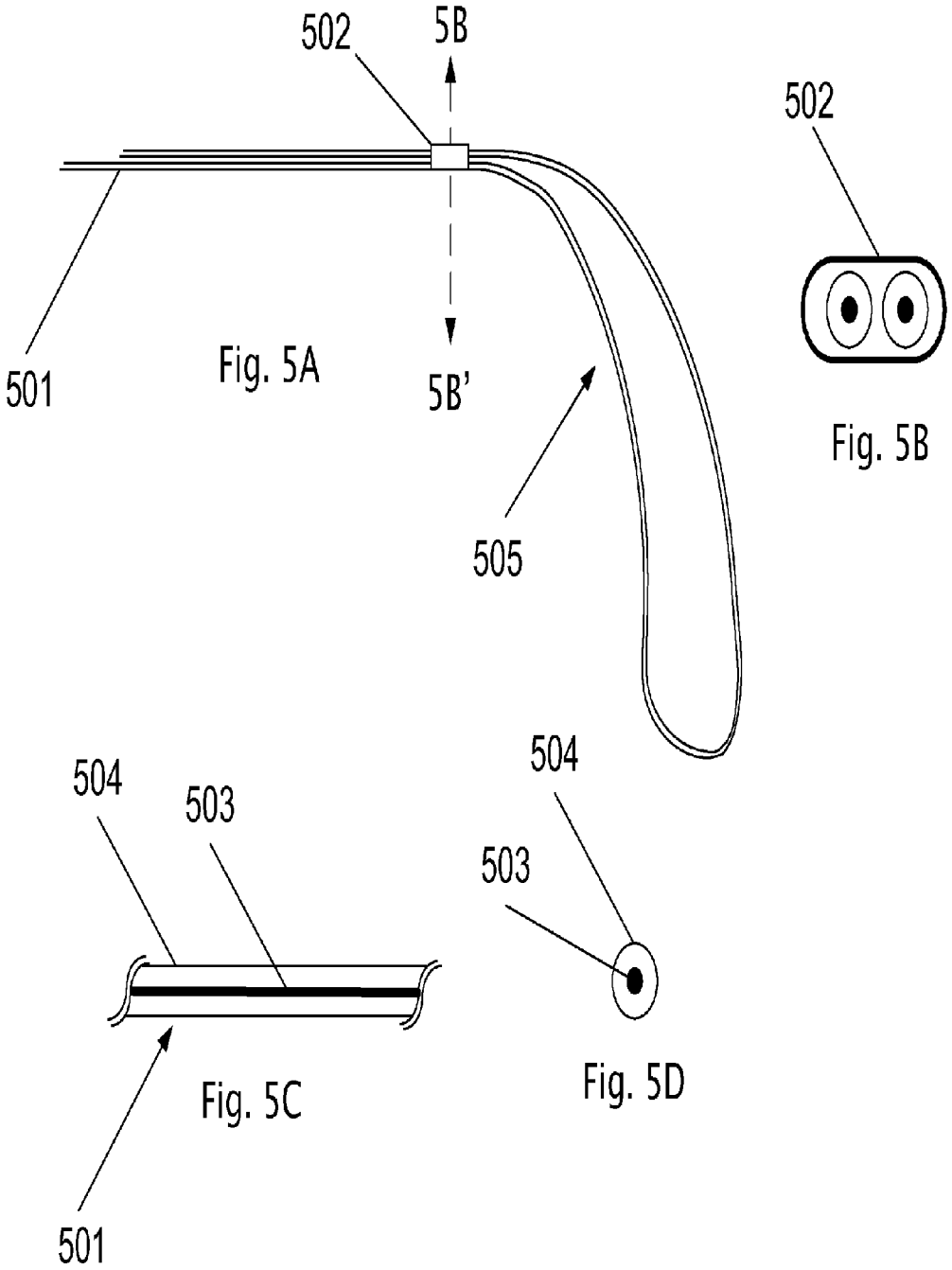
FIGS. 5A-5D are illustrations of the procedure used to secure the ends of a beaded string.

FIG. 5 indicates the general setup of the finishing process for a beaded work. Typical beading wire (501) is composed of a metallic core (503) covered by a pliable sheath (504) such as nylon as shown in FIGS. 5C-5D. The beading wire (501) is looped through a crimping sleeve (502) as shown in FIGS. 5A-5B.

Figure 1:
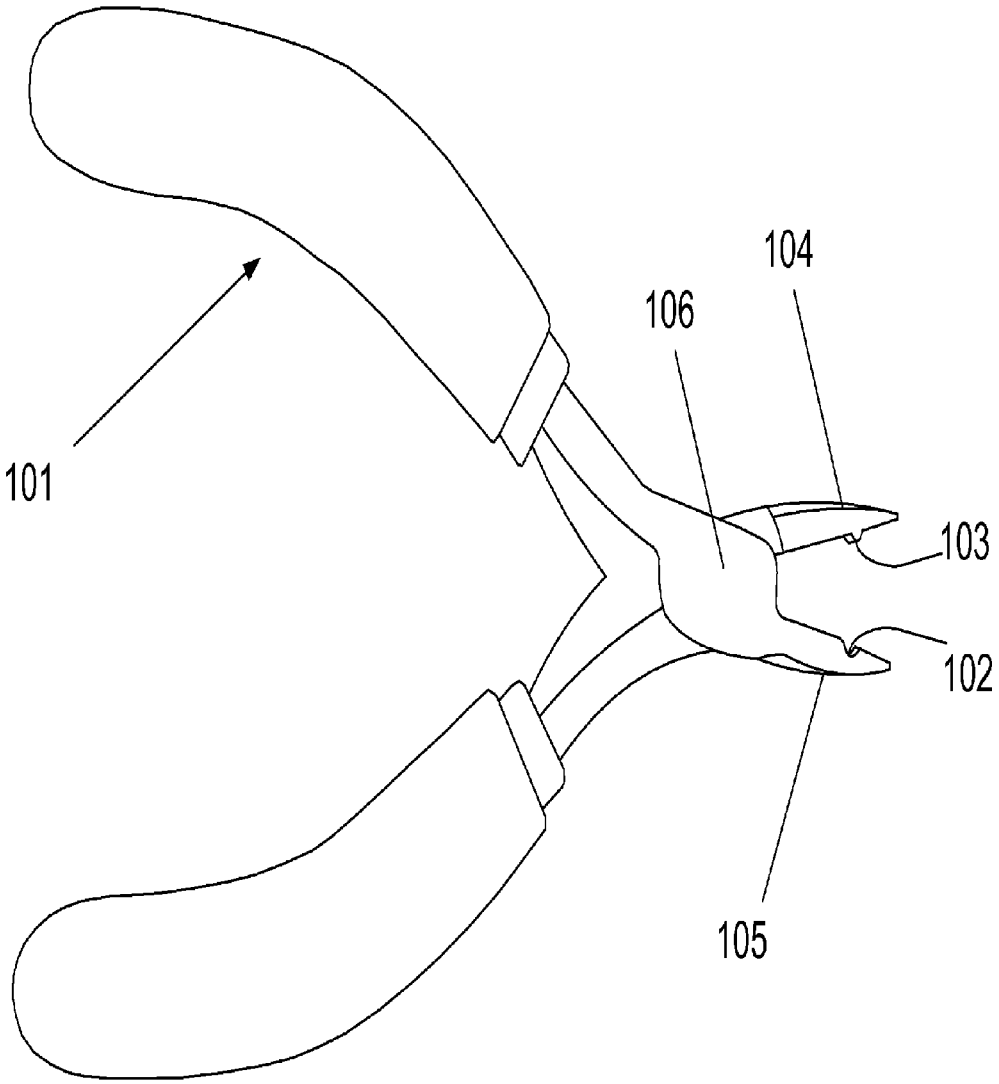
FIG. 1: Crimping tool (101) for securing the ends of a beaded string.
Figure 3:
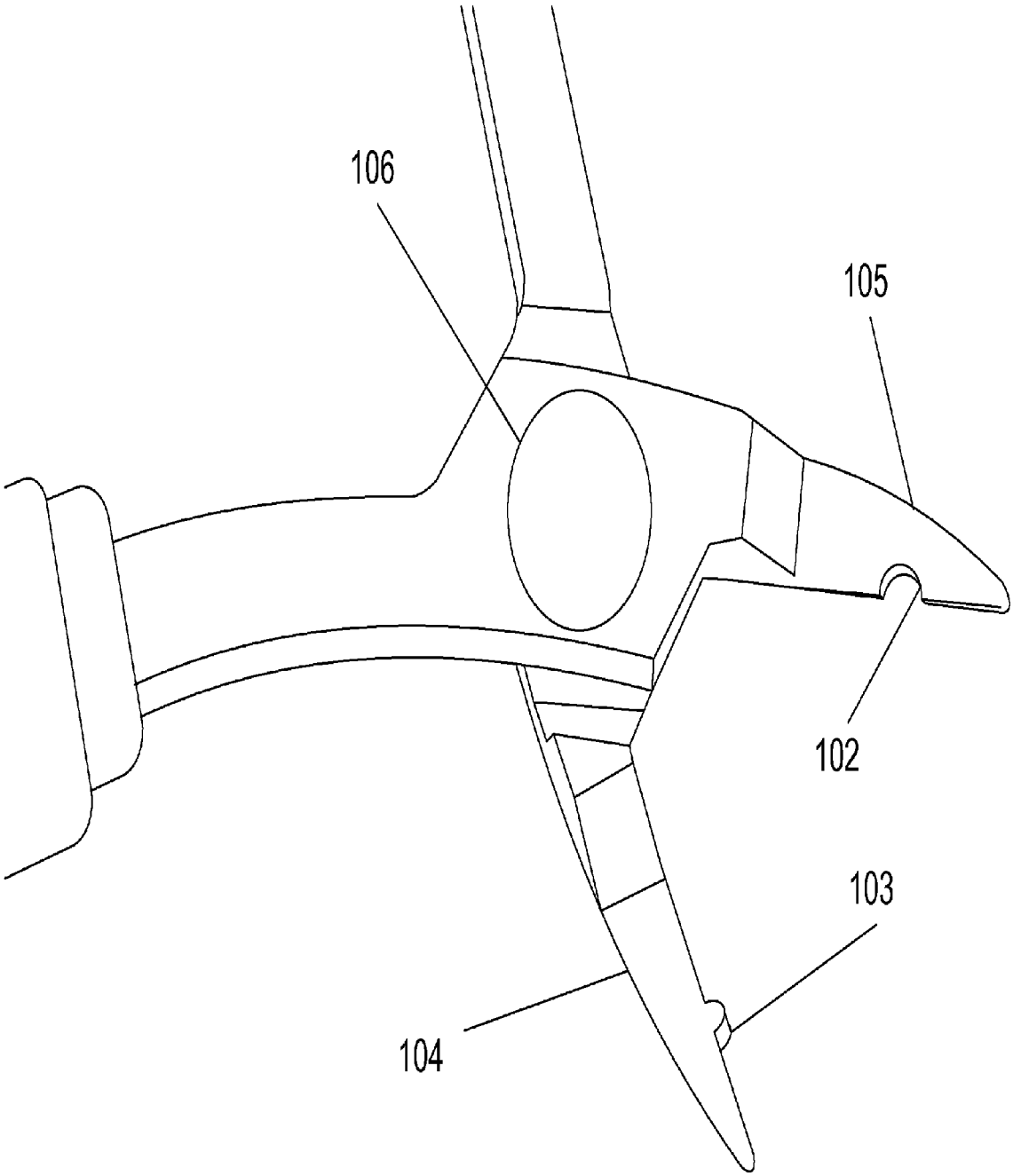
FIG. 3: Enhanced view of the nose section of a crimping tool (101) indicating the dip jaw (105), recessed dip (102), toothed jaw (104) and tooth (103).

The crimping sleeve (502) and looped strand (505) are presented to a crimping device as shown in FIG. 1 and FIG. 3. The crimping tool (101) is generally a pair of modified pliers, having a recessed area or recessed dip (102) on the interior surface of one jaw. A mated tooth (103) is configured on the interior surface of the opposing jaw immediately opposite the position of the recessed dip (102) so that a crimping sleeve (502) is flattened upon being squeezed between the toothed jaw (104) and the recessed dip jaw (105).

Figure 2:
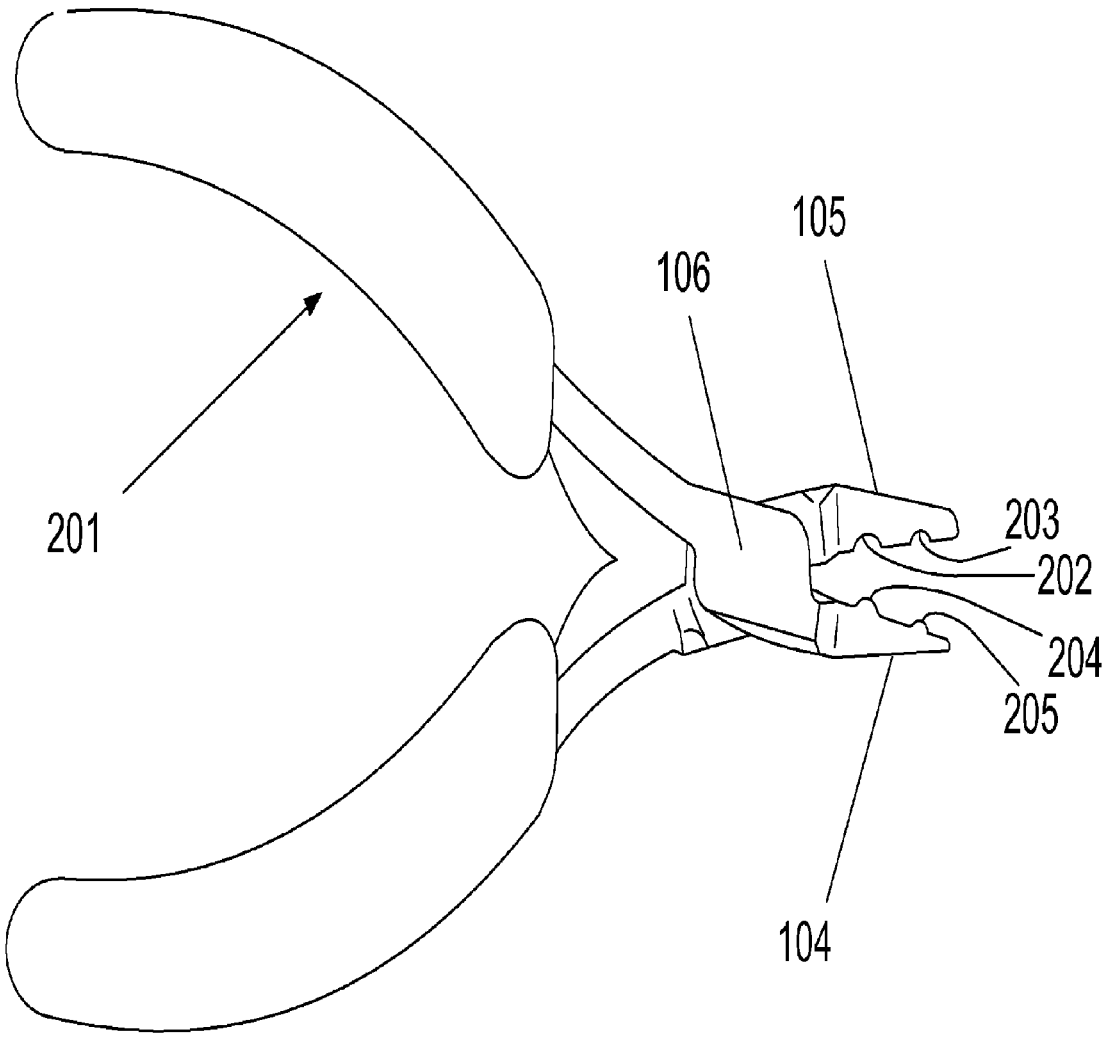
FIG. 2: Two position crimping tool (201) operable for accommodating two different sizes of a crimping sleeve (502).
Figure 4:
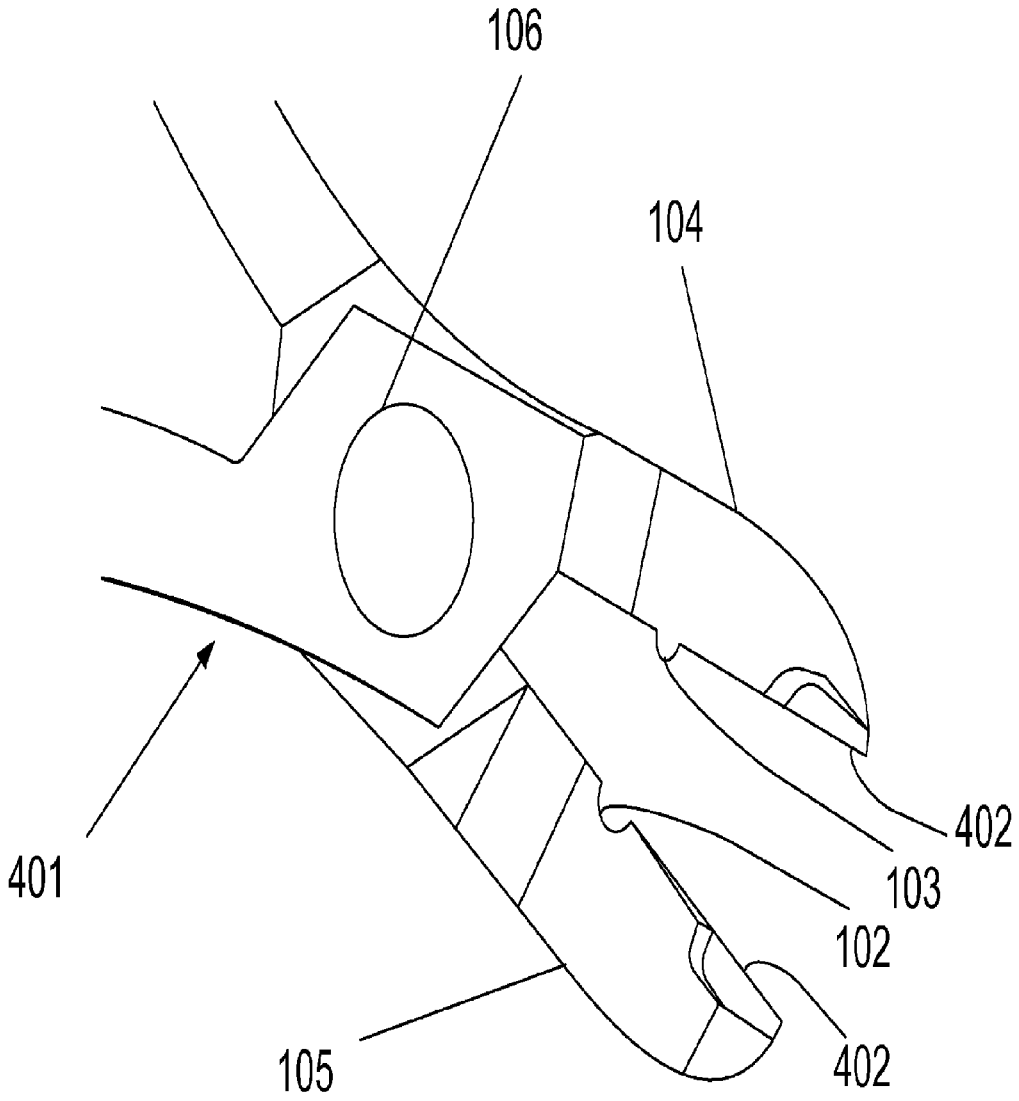
FIG. 4: Combination shear and crimping tool (401).

FIG. 2 illustrates another embodiment of the invention. Here, two crimping sites (202)/(204) and (203)/(205) are provided to accommodate two different bead sizes. FIG. 4 illustrates yet an embodiment operable for both crimping and cutting.

The inventive difference between a prior art crimping device and the present invention is the shape of the tooth as seen in FIGS. 6-7. Here the crimper nose of present device (601) is compared to the crimper nose of prior art device (701). In the embodiment shown, the recessed dip (102) of each device is essentially the same. However, as indicated in the cross section cuts of FIG. 6B and FIG. 7B, the present device has a shaped tooth (602), while the tooth of the prior art device (702) is smooth. As such, the crimping sleeve (502) is shaped differently as it undergoes the crimping process shown alternately in FIG. 6C and FIG. 7C. The finished products, FIGS. 6D and 7D are quite different as can be seen by comparing the cross sections of the bead/wire profile. FIG. 6D has a distinctively shaped surface (604) which serves to impede the motion of the bead along the length of the wire.

Figure 7A:
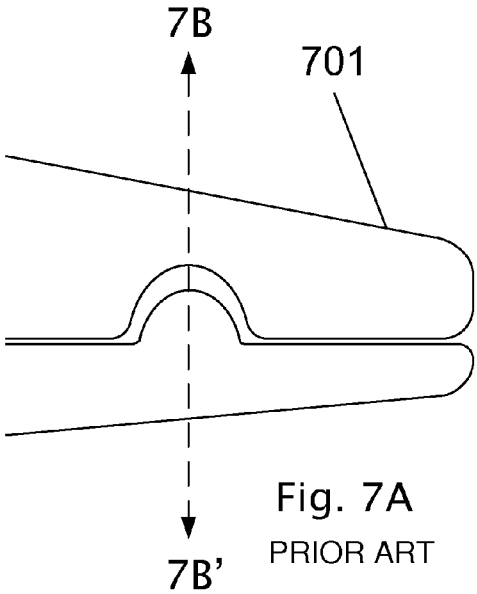
Fig. 7A PRIOR ART
FIGS. 7A-7D show details of the crimping process using a prior art crimping tool.
Figure 7B:
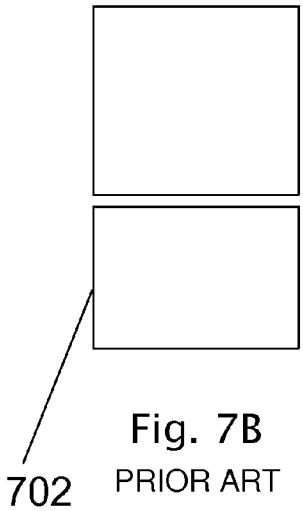
Fig. 7B PRIOR ART
Figure 7C:
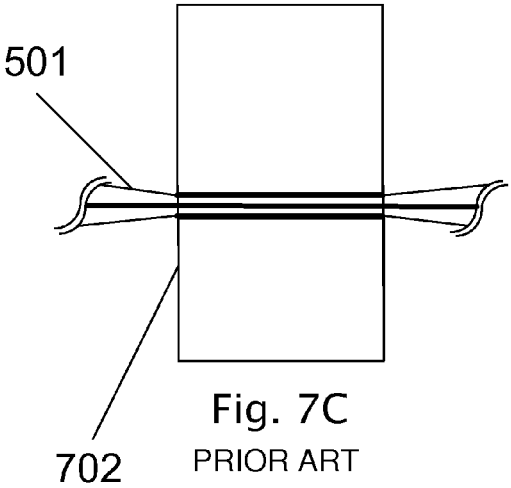
Fig. 7C PRIOR ART
Figure 7D:
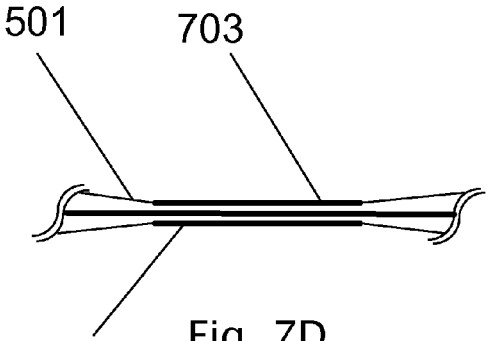
Fig. 7D PRIOR ART

Although the prior art product of FIG. 7D, with its corresponding smooth surface (704) constrains lengthwise movement, such constraint is entirely dependent upon the constriction of the crimped sleeve. Nevertheless, it still allows (by virtue of the smooth surface (704)) a direct, uninterrupted line of force to pull the wire between the ends of the pinched sleeve. This allowance of a direct line of force persists even if the crimped sleeve is folded and crimped a second time.

Figure 6A:
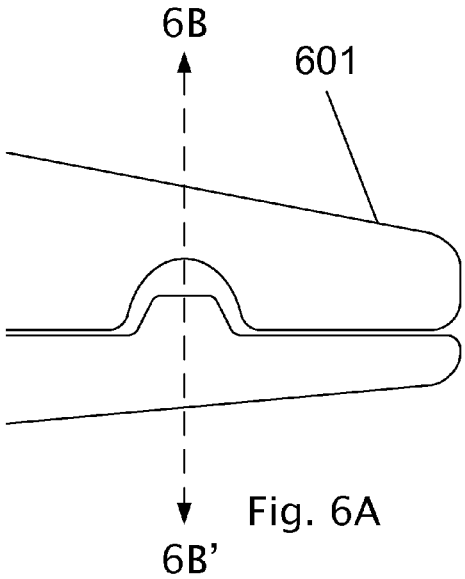
FIGS. 6A-6D show details of the crimping process using a tool of the present invention.
Figure 6B:
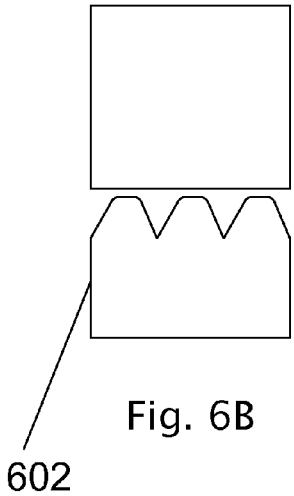
Figure 6C:
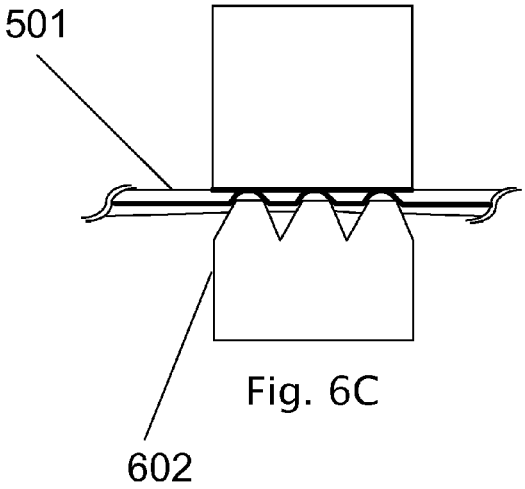
Figure 6D:
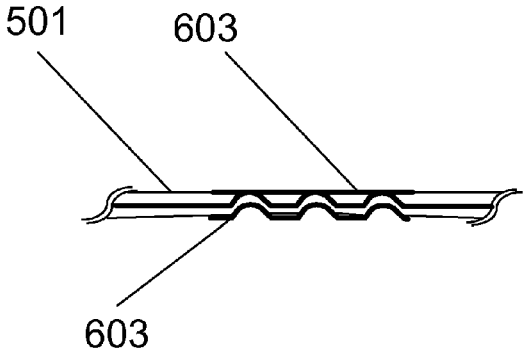

The present product of FIG. 6D, on the other hand, provides reliable insurance against unintended movement through a series of "pinches" (by virtue of the shaped surface (604)) along the length of the beading wire (502). Thus, the present crimper prevents a direct line of force to pull on the beading wire (501).

Figure 8A:
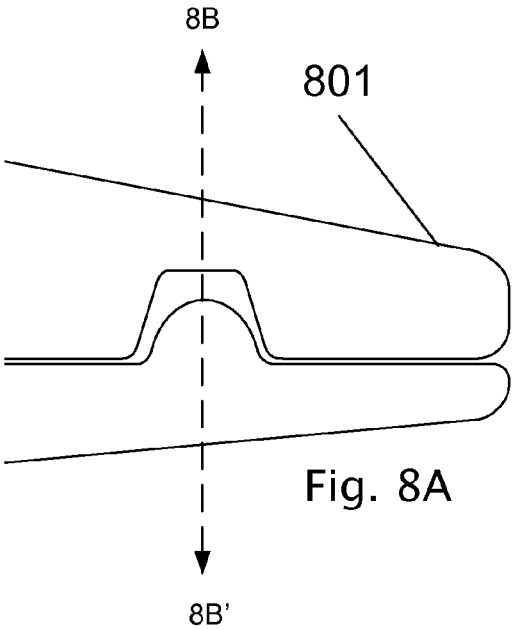
FIGS. 8A-8B show an alternative embodiment of the present invention wherein the toothed surface is incorporated into the dip recess.
Figure 8B:
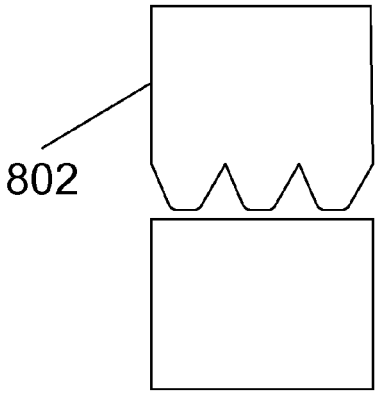
Figure 9A:
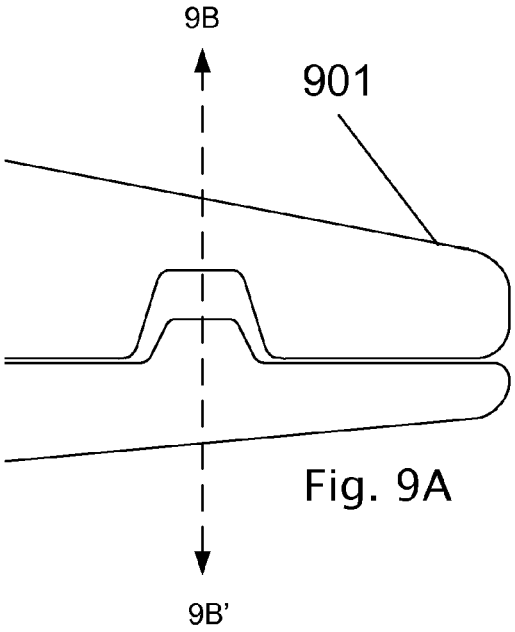
FIGS. 9A-9B show an alternative embodiment of the present invention wherein the both the dip recess and the protruding boss are shaped to form a mated pair of serrated teeth.
Figure 9B:
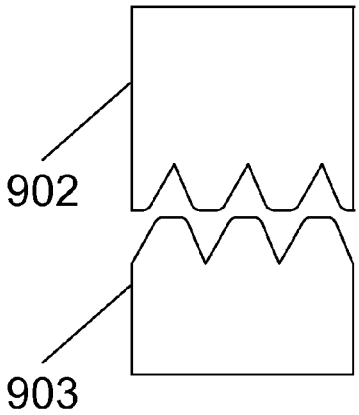

While several illustrative embodiments of the invention have been shown and described, numerous variations and alternate embodiments will occur to those skilled in the art, and can be made without departing from the spirit and scope of the invention as defined in the appended claims. Two such examples are shown in FIGS. 8-9. However, the focus of the disclosure, i.e., the basic embodiment of FIGS. 1, 3, and 6, have proven to be the most practical to use and the simplest to manufacture. All the embodiments mentioned are conceivable in the both the two position form as well as the combination crimper/shear form.

It is claimed:

1. A method of securing a crimping sleeve to a wire, comprising:

providing a crimper having first and second jaws arranged to move toward and away from one another, wherein the first jaw has a first long dimension defining a first longitudinal direction and a first width defining a lateral direction and a recessed dip positioned across the first width, and the second jaw has a second long dimension defining a second longitudinal direction and a second width along the lateral direction and a protruding boss positioned across the second width, such that a crimping site is formed by the protruding boss being mateably positioned within the recessed dip as the jaws are closed, and further wherein the protruding boss has a serrated surface comprising a parallel series of alternating teeth and grooves, wherein the parallel series is perpendicular to the second long dimension and extends in the lateral direction;

threading a crimping sleeve onto a wire;

positioning the crimper such that the crimping sleeve is held at the crimping site between the protruding boss and the recessed dip; and forming a crimp in the crimping sleeve by closing the jaws to cause the serrated surface of the protruding boss to deform the crimping sleeve against the recessed dip and secure the wire therein.

2. A method as in claim 1, wherein the crimping site is a first crimping site, and the crimper further includes a second crimping site identical to and spaced longitudinally along the jaws from the first crimping site except being of a larger size, the method including performing the steps of threading, positioning, and forming a crimp using one of the first or second crimping sites depending on the size of the crimping sleeve.

3. A method as in claim 2, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

4. A method as in claim 1, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

5. A method as in claim 1, wherein the recessed dip further has a serrated surface comprising a parallel series of alternating teeth and grooves, wherein the parallel series is perpendicular to the first long dimension and extends in the lateral direction, and during step of forming a crimp the serrated surface of the recessed dip also deforms the crimping sleeve such that a double crimp is formed.

6. A method as in claim 1, wherein the wire is a beading wire selected from the group consisting of: metallic wire, plastic line, nylon coated metallic wire, and monofilament line and the method is for making jewelry.

7. A method as in claim 1, wherein crimper comprises pliers and the first and second jaws are rotatably connected in a scissor fashion.

8. A method of securing a crimping sleeve to a wire, comprising:

providing a crimper which has a pair of jaws rotatably connected by a joint to move toward and away from one another, a first jaw having a recess and a second jaw having a shaped tooth that fits within the recess when the jaws are closed, a crimping site being formed between the recess and shaped tooth;

threading a crimping sleeve having a length onto a wire;

positioning a crimping sleeve at the crimping site; and in a single step, forming a crimp in the crimping sleeve by closing the jaws to deform the crimping sleeve against the recess with the shaped tooth such that the crimping sleeve is secured to the wire with a series of pinches along the length of the crimping sleeve formed by the shaped tooth, and further including, after the step of forming a crimp in the crimping sleeve, pressing the crimp to fold it into a generally u-shaped cross section.

9. A method as in claim 8, wherein the crimping site is a first crimping site, and the crimper further includes a second crimping site identical to and spaced longitudinally along the jaws from the first crimping site except being of a larger size, the method including performing the steps of threading, positioning, and forming a crimp using one of the first or second crimping sites depending on the size of the crimping sleeve.

10. A method as in claim 9, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

11. A method as in claim 8, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

12. A method as in claim 8, wherein the recess further has a shaped surface, and during step of forming a crimp the shaped surface of the recess also forms a series of pinches along the length of the crimping sleeve such that a double crimp is formed.

13. A method as in claim 8, wherein the wire is a beading wire selected from the group consisting of: metallic wire, plastic line, nylon coated metallic wire, and monofilament line and the method is for making jewelry.

14. A method as in claim 8, wherein the wire is a beading wire and the method is for making a necklace or bracelet.

15. A method of securing a crimping sleeve to a wire, comprising:

providing a crimper comprising pliers with a pair of jaws connected at an axis of rotation to move toward and away from one another, a first jaw having a recess and a second jaw having a shaped tooth that fits within the recess when the jaws are closed, a crimping site being formed between the recess and shaped tooth, and the shaped tooth including a serrated surface comprising a parallel series of alternating teeth and grooves spaced axially across a width of the second jaw;

threading a crimping sleeve onto a wire;

positioning a crimping sleeve at the crimping site; and in a single step, forming a crimp in the crimping sleeve by closing the jaws to deform the crimping sleeve against the recess with the shaped tooth.

16. A method as in claim 15, wherein the crimping site is a first crimping site, and the crimper further includes a second crimping site identical to and spaced longitudinally along the jaws from the first crimping site except being of a larger size, the method including performing the steps of threading, positioning, and forming a crimp using one of the first or second crimping sites depending on the size of the crimping sleeve.

17. A method as in claim 16, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

18. A method as in claim 15, wherein the first jaw further comprises a first tip and the second jaw comprises a second tip, and wherein cooperating cutting blades are incorporated into the first tip and the second tip, and the method includes cutting the wire with the cutting blades after the step of forming a crimp.

19. A method as in claim 15, wherein the recess further has a serrated surface comprising a parallel series of alternating teeth and grooves spaced axially across a width of the first jaw, and during step of forming a crimp the serrated surface of the recess also deforms the crimping sleeve such that a double crimp is formed.

20. A method as in claim 15, wherein the wire is a beading wire selected from the group consisting of: metallic wire, plastic line, nylon coated metallic wire, and monofilament line and the method is for making jewelry.

* * * * *